US010921081B2

(12) United States Patent
Pichler et al.

(10) Patent No.: US 10,921,081 B2
(45) Date of Patent: Feb. 16, 2021

(54) HOUSING FOR A FIREARM WITH AN EXCHANGEABLE BARREL

(71) Applicant: STEYR ARMS GmbH, Kleinraming (AT)

(72) Inventors: Harald Pichler, Gaflenz (AT); Markus Alexander Auinger, Behamberg (AT)

(73) Assignee: STEYR ARMS GmbH, Kleinraming (AT)

( * ) Notice: Subject to any disclaimer, the term of this patent is extended or adjusted under 35 U.S.C. 154(b) by 0 days.

(21) Appl. No.: 16/610,010

(22) PCT Filed: Mar. 14, 2018

(86) PCT No.: PCT/AT2018/060066
§ 371 (c)(1),
(2) Date: Oct. 31, 2019

(87) PCT Pub. No.: WO2018/201172
PCT Pub. Date: Nov. 8, 2018

(65) Prior Publication Data

US 2020/0080813 A1 Mar. 12, 2020

(30) Foreign Application Priority Data

May 4, 2017 (AT) ..... A 50366/2017

(51) Int. Cl.
*F41A 21/48* (2006.01)
*F41A 23/16* (2006.01)

(52) U.S. Cl.
CPC ..... *F41A 21/487* (2013.01)

(58) Field of Classification Search
CPC ..... F41A 21/48; F41A 21/485; F41A 21/487; F41A 21/00; F41C 23/16
See application file for complete search history.

(56) References Cited

U.S. PATENT DOCUMENTS 2,155,498 A * 4/1939 Laudensack ..... F41A 21/487 42/75.01
2,205,982 A * 6/1940 Klipsch ..... F41A 21/487 42/75.01

(Continued)

FOREIGN PATENT DOCUMENTS

DE 32 43 241 A1 5/1984
DE 33 26 521 A1 1/1985

(Continued)

OTHER PUBLICATIONS

International Search Report of PCT/AT2018/060066 dated May 11, 2018.

(Continued)

*Primary Examiner* — Derrick R Morgan
(74) *Attorney, Agent, or Firm* — Hoffmann and Baron, LLP

(57) ABSTRACT

The present disclosed subject matter relates to a housing for a firearm with an exchangeable barrel, comprising a bushing into which the barrel root of the exchangeable barrel may be inserted in the axial direction. The bushing has a slot in the axial direction and a clamping device for bringing the slot from a starting position into a narrowed position. The bushing is configured to receive the barrel root in a press-fitting manner when the slot is in the starting position and has a spreading device for bringing the slot from the starting position into an expanded position.

7 Claims, 1 Drawing Sheet

(56) References Cited

U.S. PATENT DOCUMENTS

Figure 2:
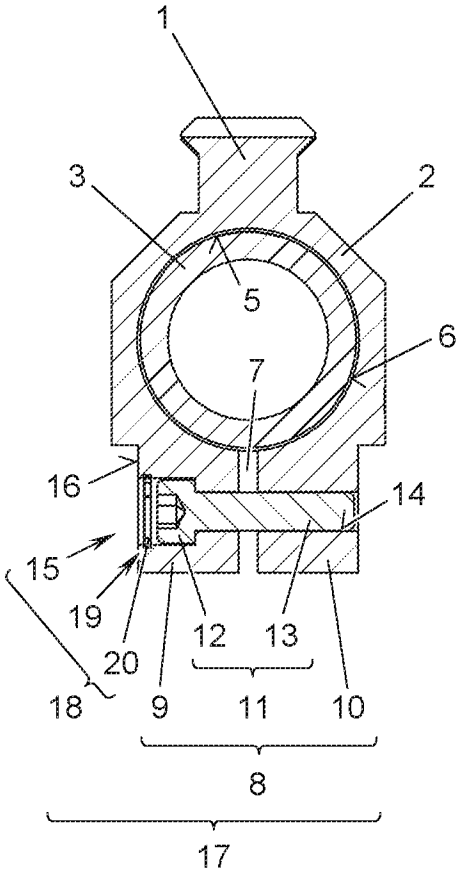

| | | | | |
|---|---|---|---|---|
| 2,543,766 | A * | 3/1951 | Davis, Jr. | F41A 21/00 89/16 |
| 3,731,418 | A * | 5/1973 | Birkenhagen | F41A 21/481 42/75.02 |
| 4,608,909 | A | 9/1986 | Peters | |
| 4,707,942 | A | 11/1987 | Peters | |
| 6,499,246 | B1 * | 12/2002 | Zedrosser | F41A 21/487 42/75.03 |
| 7,770,317 | B1 * | 8/2010 | Tankersley | F41C 23/16 42/71.01 |
| 8,904,691 | B1 * | 12/2014 | Kincel | F41C 23/16 42/71.01 |
| 9,086,247 | B2 * | 7/2015 | Lessard | F41A 35/02 |
| 9,157,697 | B2 * | 10/2015 | Leclair | F41C 23/16 |
| 9,297,609 | B2 * | 3/2016 | Burt | F41A 21/48 |
| 9,476,672 | B2 * | 10/2016 | Wells | F41G 11/003 |
| 9,683,808 | B2 * | 6/2017 | Gagnon | F41C 23/16 |
| 10,309,747 | B2 * | 6/2019 | Samson | F41A 3/66 |
| 2005/0188584 | A1 * | 9/2005 | Orth | F41A 11/04 42/71.01 |
| 2005/0188591 | A1 * | 9/2005 | Stone | F41A 21/485 42/75.02 |
| 2007/0186458 | A1 | 8/2007 | Wait | |
| 2013/0081316 | A1 * | 4/2013 | Klotz | F41C 23/00 42/75.03 |
| 2013/0219765 | A1 * | 8/2013 | Ibarguren | F41A 21/485 42/75.02 |
| 2014/0165444 | A1 * | 6/2014 | Masters | F41A 21/484 42/75.02 |
| 2015/0316347 | A1 * | 11/2015 | Shea | F41C 23/16 42/75.02 |
| 2016/0091276 | A1 * | 3/2016 | Miller | F41C 23/16 42/75.02 |
| 2017/0115094 | A1 * | 4/2017 | Gagnon | F41C 23/16 |
| 2018/0306551 | A1 * | 10/2018 | Reid | F41A 3/66 |
| 2019/0086175 | A1 * | 3/2019 | Karagias | F41A 21/482 |
| 2019/0277598 | A1 * | 9/2019 | Kincel | F41A 21/485 |

FOREIGN PATENT DOCUMENTS

| | | |
|---|---|---|
| DE | 20 2012 101 602 U1 | 6/2012 |
| DE | 10 2011 114 686 B3 | 3/2013 |
| EP | 1 398 594 A2 | 3/2004 |
| RU | 2 303 227 C1 | 7/2007 |

OTHER PUBLICATIONS

Office Action of AT Application No. A 50366/2017 dated Oct. 20, 2017.

IPRP of PCT/AT2018/060066 dated Mar. 22, 2019.

English Translation of International Preliminary Report on Patentability in corresponding International Application No. PCT/AT2018/060066 dated Mar. 22, 2019.

* cited by examiner

HOUSING FOR A FIREARM WITH AN EXCHANGEABLE BARREL

CROSS-REFERENCE TO RELATED APPLICATIONS

This application is a National Phase application of International Application No. PCT/AT2018/060066 filed Mar. 14, 2018 which claims priority to the Austrian Patent Application No. A 50366/2017 filed May 4, 2017, the disclosures of which are incorporated herein by reference.

TECHNICAL FIELD

The present disclosed subject matter relates to a housing for a firearm with an exchangeable barrel, comprising a bushing into which the barrel root of the exchangeable barrel may be inserted in the axial direction, wherein the bushing has a slot in the axial direction and a clamping device for bringing the slot from a starting position into a narrowed position.

BACKGROUND

Firearms with a housing configured for exchangeably anchoring a barrel are used in the field of hunting and sporting weapons and in particular as sniper rifles. Both the bushing of the housing and the barrel root must be produced under stringent precision requirements, see, e.g. DE 20 2012 101 602 U1. If there is too little clearance between the two parts, it would not be possible to insert the barrel root into the bushing of the housing. If there is a great deal of clearance, the clamping device would have to compensate this in that the clamping device would deform the bushing more severely, which would lead to undesired tensions in the housing and to an elevated load on the clamping device itself (the clamping device having to apply all of the clamping force itself), and would have a negative effect on the precision of the anchoring of the barrel root on the housing.

BRIEF SUMMARY

The object of the present disclosed subject matter is to provide an improved housing for a firearm with an exchangeable barrel, which housing is simple to produce and offers the exchangeable barrel a secure, precise seat on the housing, despite the uncomplicated exchange of the barrel.

According to the disclosed subject matter, this object is attained with a housing of the aforesaid type that is distinguished in that the bushing is configured to receive the barrel root in a press-fitting manner when the slot is in the starting position, which is uninfluenced by the clamping device, and has a spreading device for bringing the slot from the starting position into an expanded position.

The spreading device makes it significantly easier to insert the barrel root of the exchangeable barrel in the axial direction into the bushing in that the spreading device expands the bushing by expanding the slot. This can lower the precision requirements for the production of bushing and barrel root. The barrel root is assured highly precise seating in the bushing because the barrel root is already received in the bushing in a press-fitting manner with the slot in the starting position uninfluenced by the spreading device. When the slot is in the narrowed position, the barrel root, and thus the exchangeable barrel, is particularly securely anchored on the housing without the clamping device having to apply the entire force required for this by itself.

In the disclosed subject matter, the housing has a common actuating element for the clamping device and for the spreading device. In this way clamping device and spreading device form a unit that facilitates operation and in particular saves space and weight. It is particularly advantageous in this case that the actuating element has two actuating directions, in one of which the slot may be brought from its starting position into its narrowed position, and in the other of which the slot may be brought from its starting position into its expanded position. Clamping device and spreading device in this case may never act in opposition to one another. The actuating device becomes the clamping device by actuating in one direction, and becomes the spreading device by actuating in the other direction, and vice versa.

It is advantageous when the bushing has legs embodied on both sides of the slot and the clamping device is formed by the legs and at least one tensioning screw that is rotatably borne by its screw head on one leg and that engages with its thread in a female thread of the other leg, wherein the slot may be brought from its starting position into its narrowed position by tightening the tensioning screw. It is particularly advantageous when the spreading device is formed by the legs, the tensioning screw, and an axial bearing that axially fixes the tensioning screw in the aforesaid one leg, wherein the slot may be brought from its starting position into its expanded position by loosening the tensioning screw. In this way the construction of both the clamping device and of the spreading device is space-saving and robust and simple to manage. Furthermore, the tensioning screw may optionally be the aforesaid common actuating element, so that clamping device and spreading device form a unit that facilitates operation and in particular saves space and weight. Clamping device and spreading device in this case may never act in opposition to one another. If the clamping device is released by loosening the tensioning screw, it automatically becomes the spreading device merely by further rotation of the tensioning screw and vice versa. Since the clamping device does itself not have to apply the entire force required for anchoring the barrel in the bushing of the housing, a single tensioning screw is sufficient for anchoring the barrel securely to the housing.

It is advantageous in this case when the axial bearing is formed by a countersunk bore with a circumferential groove and a ring received in the circumferential groove, wherein the screw head is axially fixed in the countersunk bore by the ring. In this way screw head and axial bearing are largely protected from environmental influences and do not have a negative effect when the firearm is used. At the same time, it is possible to actuate clamping device and spreading device in a simple manner at any time. The ring is preferably optionally a locking ring, a snap ring, or a spiral locking ring. Locking ring and snap ring are simple to use and to remove, the snap rig being more flexible, while the locking ring effects more uniform wear on the groove; on the other hand, the spiral locking ring produces even more uniform contact with the groove, but is more difficult to use and remove. Thus the most suitable ring may be selected according to what is required.

In one embodiment, the bushing is integral with the housing. In this way a particularly stable seat for the exchangeable barrel directly on the housing is assured.

BRIEF DESCRIPTION OF THE DRAWINGS/FIGURES

The disclosed subject matter shall be described in greater detail in the following using an exemplary embodiment illustrated in the attached drawings.

Figure 1:
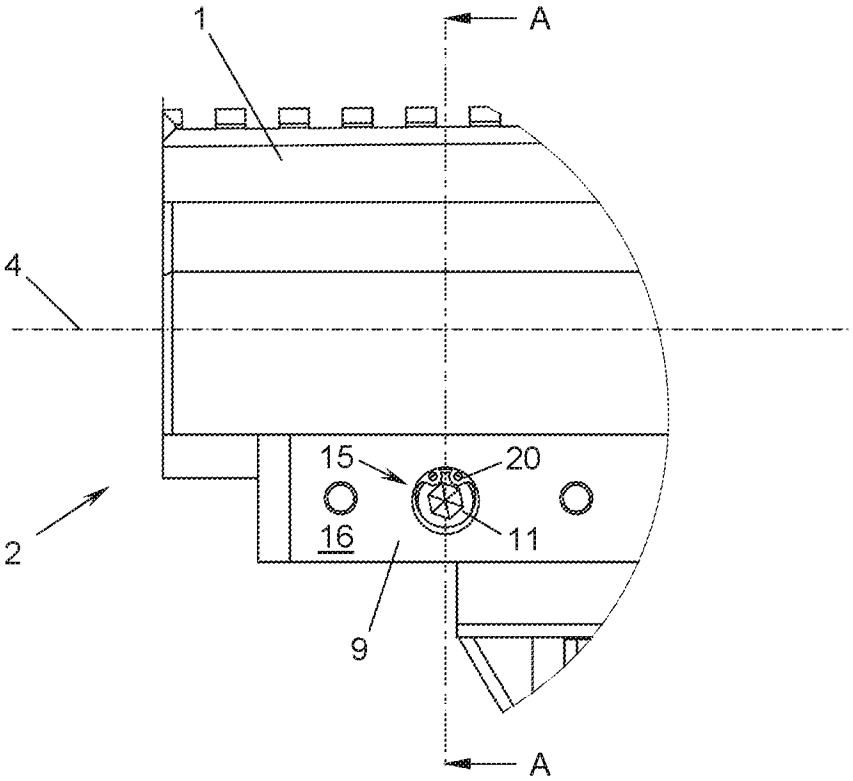

FIG. 1 is a side view of a segment of an inventive housing for a firearm for receiving a barrel root of an exchangeable barrel; and, FIG. 2 illustrates a cross-section of the housing from FIG. 1, with barrel root inserted, along the sectional line A-A.

DETAILED DESCRIPTION

The example in FIG. 1 and FIG. 2 illustrates a segment of a housing 1 for a firearm. The housing 1 comprises a bushing 2 in which the barrel root 3 of an exchangeable barrel for the firearm is seated (FIG. 2). To this end, the barrel root 3 is inserted into the bushing 2 in the direction of the longitudinal axis 4 of the firearm, which is simultaneously the longitudinal axis 4 of the exchangeable barrel and the housing 1, and is anchored therein.

In the example in FIG. 2, the barrel root 3 has a circular outer circumference 5 and the bushing 2 has a corresponding, and therefore likewise circular, inner circumference 6. It is understood that bushing 2 and barrel root 3 may alternatively have other shapes corresponding to one another, e.g. a polygonal or oval cross-section, and it is also possible for the barrel root 3 to have a guide lug or the like and for the bushing 3 to have a corresponding groove, or vice versa.

The bushing 2 furthermore has a slot 7 running in the direction of the longitudinal axis 4 and a clamping device 8. Using the clamping device 8, it is possible to bring the slot 7 from its starting position, illustrated in FIG. 2, in which it is not influenced by the clamping device 8, into a narrowed position in which the barrel root 3 is securely anchored in the bushing 2 and thus on or to the housing 1. The bushing 2 is configured such that it receives the barrel root 3 in a press-fitting manner even in the starting position of the slot 7, which position is not influenced by the clamping device 8.

In the example in FIGS. 1 and 2, the clamping device 8 is formed by two legs 9, 10, which are embodied on the bushing 2 on either side of the slot 7, and one or a plurality of tensioning screws 11 (in this case: one tensioning screw). The tensioning screw 11 is rotatably borne by its screw head 12 at the one leg 9 of the bushing 2 and its thread 13 engages in a female thread 14 of the other leg 10 of the bushing 2. The screw head 12 is borne in a countersunk bore 15 of the aforesaid one leg 9; alternatively, the screw head 12 could e.g. simply be supported, axially in the direction of the other leg 10, against the outside 16 of the one leg 9 or in another manner. In the exemplary embodiment in FIG. 2, the slot 7 is brought from its starting position into its narrowed position simply by tightening the tension screw 11.

In order to be able to insert the barrel root 3 axially into the bushing 2, although the bushing 2 is configured for receiving the barrel root 3 in a press-fit, the bushing 2 furthermore has a spreading device 17. The slot 7 may be brought from its starting position into an expanded position, in which the bushing 2 is spread apart, using the spreading device 17.

In the example in FIGS. 1 and 2, the spreading device 17 is formed by the legs 9, 10, the tensioning screw 11, and an axial bearing 18 that axially fixes the tensioning screw 11 in the aforesaid one leg 9 in its two axial directions. In this way, the slot 7 may be brought from its starting position into its expanded position by loosening the tensioning screw 11, i.e., (at least partially) unscrewing the tensioning screw 11 from the aforesaid other leg 10.

In the example depicted, the axial bearing is formed by the countersunk bore 15, a circumferential groove 19 embodied in the countersunk bore 15, and a ring 20 (in this case a locking ring) received in the circumferential groove 19. In this way, the screw head 12 is axially fixed in its axial direction in the countersunk bore 15 and in its other axial direction by the locking ring 20. The axial bearing 18 could be embodied in another manner, e.g. in the one axial direction of the tensioning screw 11 by a pivot lever or sliding bar partially covering the countersunk bore 15 on the outside 16 of the one leg 9 or by a locking ring that is received in the interior of the slot 7 in a groove of the tensioning screw 11, and in the other axial direction of the tensioning screw 11 furthermore by the leg 9 or the countersunk bore 15.

It is understood that a snap ring or a spiral locking ring or the like may be used instead of the locking ring 20 illustrated in the example in FIGS. 1 and 2.

In the example illustrated, the bushing 2 is embodied integral with the housing 1, i.e., as part of the housing 1. Alternatively, the bushing 2 could also be separate from the housing 1 and thus anchored on or in the housing 1.

Furthermore, clamping device 8 and spreading device 17 may be formed in a manner other than by the legs 9, 10, tensioning screw 11, and axial bearing 18. For example, the tensioning device 8 could be, e.g. a lever or cam apparatus, a sliding guide, or a clip spanning the bushing 2. The spreading device 17 could also be embodied as a lever or cam apparatus or sliding guide, and thus independent of the clamping device 8, and be for operating, or it could have at least one actuating element in common with the clamping device 8 e.g. a sliding guide, a lever or cam apparatus, or the aforesaid common tensioning screw 11. The common actuating element in this case optionally has two actuating directions, in one of which the slot 7 is brought from its starting position into its narrowed position and in the other of which the slot 7 is brought from its starting position into its expanded position.

The disclosed subject matter is not limited to the depicted embodiments, but instead encompasses all variants, combinations, and modifications that fall within the scope of the attached claims.

What is claimed is:

1. A housing for a firearm with an exchangeable barrel which has a barrel root, comprising:

a bushing into which the barrel root of the exchangeable barrel may be inserted in an axial direction, wherein the bushing has a slot in the axial direction and a clamping device for bringing the slot from a starting position, in which the slot is uninfluenced by the clamping device, into a narrowed position, wherein the bushing is configured to receive the barrel root in a press-fitting manner when the slot is in the starting position, wherein the bushing has a spreading device for bringing the slot from the starting position into an expanded position, wherein a common actuating element is provided for the clamping device and the spreading device, wherein the bushing has two legs each of which is embodied on one side of the slot, wherein the clamping device is formed by said legs and at least one tensioning screw that is rotatably borne by a screw head of the tensioning screw on one of said legs and that engages with a thread of the tensioning screw in a female thread of the other of said legs, wherein the slot may be brought from the starting position into the narrowed position by tightening the tensioning screw, wherein the spreading device is formed by said legs, the tensioning screw, and an axial bearing that axially fixes the tensioning screw in the aforesaid one of said legs, wherein the slot may be brought from the starting position into the expanded position by loosening the tensioning screw, wherein the axial bearing is formed by a countersunk bore with a circumferential groove and a ring received in the circumferential groove, and wherein the screw head is axially fixed in the countersunk bore by the ring.

2. The housing according to claim 1 wherein the actuating element has two actuating directions, in one of which the slot may be brought from the starting position into the narrowed position, and in the other of which the slot may be brought from the starting position into the expanded position.

3. The housing according to claim 2, wherein the bushing has two legs each of which is embodied on one side of the slot, wherein the clamping device is formed by said legs and at least one tensioning screw that is rotatably borne by a screw head of the tensioning screw on one of said legs and that engages with a thread of the tensioning screw in a female thread of the other of said legs, and wherein the slot may be brought from the starting position into the narrowed position by tightening the tensioning screw.

4. The housing according to claim 3, wherein the spreading device is formed by said legs, the tensioning screw, and an axial bearing that axially fixes the tensioning screw in the aforesaid one of said legs, wherein the slot may be brought from the starting position into the expanded position by loosening the tensioning screw.

5. The housing according to claim 3, wherein the bushing is integral with the housing.

6. The housing according to claim 1, wherein the ring is a locking ring, a snap ring, or a spiral locking ring.

7. The housing according to claim 1, wherein the bushing is integral with the housing.

* * * * *